US010174463B1

(12) United States Patent
Yuan et al.

(10) Patent No.: US 10,174,463 B1
(45) Date of Patent: Jan. 8, 2019

(54) SKI MAT AND SPLICED BASEPLATE THEREOF

(71) Applicant: QINGDAO LIGHTNING SPORTS EQUIPMENT CO., LTD., Qingdao (CN)

(72) Inventors: Wei Yuan, Qingdao (CN); Yonggang Yang, Qingdao (CN); Weitao Gong, Qingdao (CN)

(73) Assignee: QINGDAO LIGHTNING SPORTS EQUIPMENT CO., LTD., Shandong (CN)

( * ) Notice: Subject to any disclaimer, the term of this patent is extended or adjusted under 35 U.S.C. 154(b) by 0 days.

(21) Appl. No.: 15/739,153

(22) PCT Filed: Jan. 11, 2017

(86) PCT No.: PCT/CN2017/070903

§ 371 (c)(1),
(2) Date: Dec. 21, 2017

(87) PCT Pub. No.: WO2017/211086

PCT Pub. Date: Dec. 14, 2017

(30) Foreign Application Priority Data

Sep. 18, 2016 (CN) ..... 2016 1 0826308
Sep. 18, 2016 (CN) ..... 2016 2 1058661 U
(Continued)

(51) Int. Cl.
*A63C 19/10* (2006.01)
*E01C 13/12* (2006.01)
*A63C 19/04* (2006.01)

(52) U.S. Cl.
CPC ..... *E01C 13/12* (2013.01); *A63C 19/04* (2013.01); *A63C 19/10* (2013.01)

(58) Field of Classification Search
CPC ..... A63C 19/00; A63C 19/02; A63C 19/04; A63C 19/10; E01C 13/12; E01C 13/002; E01C 13/065
(Continued)

(56) References Cited

U.S. PATENT DOCUMENTS 3,959,542 A * 5/1976 Livermore ..... E01C 13/12 428/44
4,179,539 A 12/1979 Schweizer ..... 428/58
(Continued)

FOREIGN PATENT DOCUMENTS

CN 1160595 A 10/1997
CN 101091833 A 12/2007
(Continued)

OTHER PUBLICATIONS

International Search Report of corresponding International PCT Application No. PCT/CN2017/070903, dated Jun. 22, 2017.
(Continued)

*Primary Examiner* — Kien Nguyen
(74) *Attorney, Agent, or Firm* — J.C. Patents

(57) ABSTRACT

A ski mat is provided in the present application, comprising a baseplate used for paving a ski field and a plurality of supports mounted on the baseplate to support skiing tools, wherein a mounting base capable of mounting the supports on the baseplate is provided on bottoms of the supports, and a plurality of connectors are provided on a bottom of the mounting base; a plurality of mounting holes capable of clamping the connectors are provided on the baseplate at positions corresponding to the connectors; and, the connectors is clamped into the mounting holes so that the supports are mounted on the baseplate. By clamping the connectors arranged on the supports to the baseplate, it is firmer and difficult to result in a separation of the baseplate and the supports, thus it is safer. The present application also provides a spliced baseplate used for the ski mat.

18 Claims, 12 Drawing Sheets

(30) Foreign Application Priority Data

Dec. 16, 2016 (CN) ..... 2016 2 1391865 U
Dec. 16, 2016 (CN) ..... 2016 2 1392742 U

(58) Field of Classification Search
USPC ..... 472/88–91; 428/44, 85, 91, 99
See application file for complete search history.

(56) References Cited

U.S. PATENT DOCUMENTS

| | | | | | |
|---|---|---|---|---|---|
| D260,107 | S * | 8/1981 | Mittmann | 472/90 | |
| 5,507,695 | A * | 4/1996 | Sajakorpi | A63C 19/10 472/88 | |
| 5,647,804 | A * | 7/1997 | Homma | A63C 19/04 472/90 | |
| 6,199,335 | B1 * | 3/2001 | Brenot | A63C 19/04 472/90 | |
| 6,634,953 | B1 * | 10/2003 | Czintos | A63C 19/10 104/69 | |
| 2008/0020852 | A1 * | 1/2008 | McBrien | A63C 19/02 472/90 | |

FOREIGN PATENT DOCUMENTS

| | | | |
|---|---|---|---|
| CN | 201785690 | U | 4/2011 |
| CN | 202191672 | U | 4/2012 |
| CN | 104492070 | A | 4/2015 |
| CN | 204840891 | U | 12/2015 |
| CN | 205134138 | U | 4/2016 |
| CN | 205287554 | U | 6/2016 |
| CN | 205391693 | U | 7/2016 |
| CN | 105908597 | A | 8/2016 |
| CN | 106215409 | A | 12/2016 |
| CN | 206103283 | U | 4/2017 |
| DE | 24 34 622 | A1 | 2/1975 |
| JP | H04-174106 | A | 6/1992 |
| JP | 2011-030674 | A | 2/2011 |

OTHER PUBLICATIONS

The Chinese Search Report of corresponding Chinese patent No. 201610826308.0.

* cited by examiner

SKI MAT AND SPLICED BASEPLATE THEREOF

CROSS-REFERENCE TO RELATED APPLICATION

This application is a national phase application of international application No. PCT/CN2017/070903 filed on Jan. 11, 2017, which in turn claims the priority benefits of Chinese application No. 201621058661.0, filed on Sep. 18, 2016, Chinese application No. 201610826308.0, filed on Sep. 18, 2016, Chinese application No. 201621391865.6, filed on Dec. 16, 2016, and Chinese application No. 201621392742.4, filed on Dec. 16, 2016. The contents of these prior applications are hereby incorporated by reference in their entirety.

TECHNICAL FIELD

The present application relates to a field of artificial skiing slideway and in particular to a ski mat and a spliced baseplate thereof.

BACKGROUND OF THE PRESENT INVENTION

Skiing is more and more popular with people, but natural ski fields cannot timely and effectively meet use requirements of skiers due to limitations of temperature and season and of high maintenance cost. Therefore, artificial ski fields emerge at the right moment.

Chinese Utility Model Patent CN 202191672U has disclosed a combination unit for dry skiing slideway comprising: a mounting plate having a plurality of mounting members; and a plurality of comb-shaped components each having a base fitted with the mounting member on the mounting plate and a plurality of elastic support sheets in a high-low way alternately arranged on the base, and an arc contact surface in contact with a snowboard is arranged at a top of each elastic support sheet.

In the aforementioned patent, although a fitting of a support member and a base plate can be realized by a fitting of the base and the mounting member, only by a simple concave-convex fitting, it is very likely to result in a slippage of the support member from the base plate due to a large stress, which is dangerous for skiers.

In addition, prior artificial fields are generally integrated ski mats. Such a ski mat is fast in installation, but it is very difficult to maintain and disadvantageous for replacements of easy-to-damage components. Furthermore, prior spliced ski mats are generally spliced by changing structures of baseplates. Chinese Invention Patent CN 1160595A has disclosed a ski slope special for artificial skiing and a production method thereof. In the invention patent, a disclosed slope comprises gaskets which are arranged longitudinally and transversely and connected to each other. Each gasket has a plurality of protrusions on its rear side, and at least one connecting member has a side wall in concave-convex occlusion with an outer periphery of the protrusion.

In this invention, although baseplates can be spliced, structural changes in different forms need to be made to adjacent baseplates, so that the production is tedious. Moreover, the baseplates must be used in pairs, resulting in great limitation.

SUMMARY OF THE PRESENT INVENTION

To solve the aforementioned problems, the present application provides a ski mat of which connectors on supports are clamped on a baseplate. In this way, it is firmer, and a separation of the baseplate and the support is less likely to occur and it is thus safer.

For this purpose, the present application employs the following technical solutions.

A ski mat, comprising a baseplate used for paving a ski field and a plurality of supports mounted on the baseplate to support skiing tools, wherein a mounting base capable of mounting the supports on the baseplate is provided on bottoms of the supports, and a plurality of connectors are provided on a bottom of the mounting base; a plurality of mounting holes capable of clamping the connectors are provided on the baseplate at positions corresponding to the connectors; and, the connector is clamped into the mounting hole so that the supports are mounted on the baseplate.

The present application further provides a spliced baseplate which may be applied to the ski mat. The spliced baseplate can be flexibly spliced into different size according to topographies, and a size of each baseplate is not defined.

The technical solution of the spliced baseplate will be described below.

A spliced baseplate, which may be used for mounting the supports of the ski mat, comprising a plurality of baseplates, the baseplates are quadrangular, wherein a plurality of first mounting parts are arranged at intervals on two opposite sides of the quadrangular baseplates, a plurality of second mounting parts are arranged at intervals on other two opposite sides of the quadrangular baseplates, and the first mounting parts or the second mounting parts of two adjacent baseplates are aligned with each other; and, the first mounting parts of two adjacent baseplates are connected by first connecting buckles and the second mounting parts of two adjacent baseplates are connected by second connecting buckles to form a baseplate of different size.

BRIEF DESCRIPTION OF THE DRAWINGS

FIG. 17 is a partially enlarged view of a second mounting part 27 of FIG. 10, in which:

Figure 1:
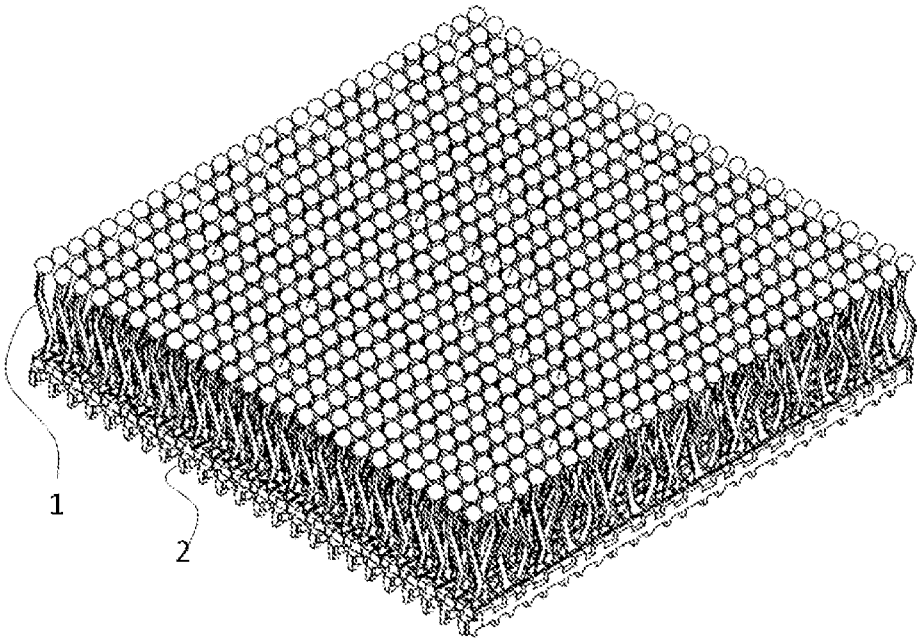
FIG. 1 is a perspective view of a ski mat.
Figure 2:
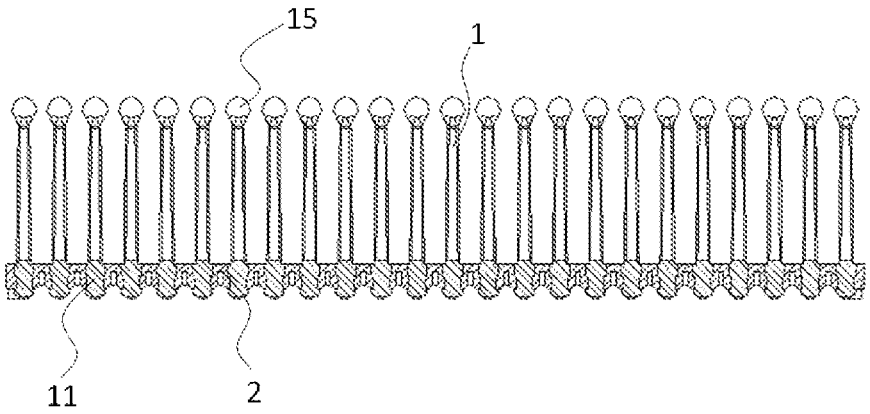
FIG. 2 is a structurally sectional view of the ski mat.

1: support; 101: first support; 102: second support; 103: third support; 104: fourth support; 105: upper support; 106: lower support; 11: mounting base; 12: connector; 13: clamping part; 14: clamping slot; 15: bud head; 151: first bud head;

152: second bud head; 2: baseplate; 2A: first baseplate; 2B: second baseplate; 2C: third baseplate; 21: mounting hole; 211: first mounting hole; 212: second mounting hole; 22: bump; 23: boss; 24: first connecting buckle; 241: first buckle body; 242: first telescopic member; 243: first flange; 244: clamping space; 25: second connecting buckle; 251: second buckle body; 252: second telescopic member; 253: convex column; 254: second flange; 255: middle convex column; 26: first mounting part; 261: baffle; 27: second mounting part; 271: buckling part; and, 272: fastening part.

DETAILED DESCRIPTION OF THE PRESENT INVENTION

The present application will be described below in more details by specific implementations. However, it should be understood that, unless otherwise stated, elements, structures and features in one implementation can be advantageously combined in other implementations.

A technical solution of a ski mat will be described below.

A ski mat, comprising a baseplate used for paving a ski field and a plurality of supports mounted on the baseplate to support skiing tools, wherein a mounting base capable of mounting the supports on the baseplate is provided on bottoms of the supports, and a plurality of connectors are provided on a bottom of the mounting base; a plurality of mounting holes capable of clamping the connectors are provided on the baseplate at positions corresponding to the connectors; and, the connector is clamped into the mounting hole so that the supports are mounted on the baseplate.

As an implementation, a clamping part protruded from an outside face of the connector is integrally provided on a bottom of the connector; the mounting hole comprises two holes connected successively, i.e., a first mounting hole and a second mounting hole, wherein the first mounting hole and the second mounting hole are two arc segments having different diameters. The diameter of the first mounting hole is greater than the diameter of the second mounting hole and is not less than a maximum distance between outside faces of the clamping part. The diameter of the second mounting hole is less than the maximum distance between the outside faces of the clamping part and is not less than a maximum distance between outside faces of the connector.

As an implementation, a plurality of bumps protruded from the baseplate are provided on the baseplate, and the bump is arranged between two adjacent mounting holes in a direction for mounting the supports; and, clamping slots capable of clamping the bumps are formed on the mounting base at positions corresponding to the bumps, and the clamping slots are concavely arranged on the bottom of the mounting base.

Preferably, an upper surface of the bump is an inclined surface, and side faces of the bump are vertical surfaces; and, an inward concave bottom surface of the clamping slot is an inclined surface arranged in correspondence to the bump, and side faces of the clamping slot are vertical surfaces capable of being fitted to the vertical surfaces of the bump.

As an implementation, a plurality of bosses protruded from the baseplate are provided on the baseplate, and the bosses are arranged between two adjacent rows of the mounting holes correspondingly to the mounting holes. In this case, two adjacent rows of the mounting holes may be separated by one row of the bosses.

The support may be an arc-shaped strip from top to bottom. As an implementation, four of the supports form one group of the supports. Each group of the supports comprises two supports having radians which are left-right symmetrical and two supports having radians which are front-rear symmetrical. Therefore, each group of the supports has four bending directions and can effectively withstand stress generated by skiing in multiple directions.

A round-headed bud head may be provided on a top of the support. As an implementation, the support comprises two supports arranged up and down, i.e., an upper support and a lower support, wherein a bottom of the lower support is mounted on the mounting base, a first bud head is provided between the lower support and the upper support, and a second bud head is provided on a top of the upper support.

Preferably, the upper support and the lower support are eccentrically arranged on the first bud head and are distributed on two sides of the first bud head, respectively. When four of the supports form one group of the supports, eccentric directions of two supports are left-right symmetrical, and eccentric directions of other two supports are front-rear symmetrical. Due to different eccentric directions, the supports can withstand the stress generated by skiing in multiple directions.

The technical solution of the spliced baseplate will be described below.

A spliced baseplate, which may be used for mounting the supports of the ski mat, comprising a plurality of baseplates, wherein the baseplates are quadrangular, and a plurality of first mounting parts are arranged at intervals on two opposite sides of the quadrangular baseplates, a plurality of second mounting parts are arranged at intervals on other two opposite sides of the quadrangular baseplates, and the first mounting parts or the second mounting parts of two adjacent baseplates are aligned with each other, that is, the plurality of first mounting parts are aligned with each other and the plurality of second mounting parts are aligned with each other; and, the first mounting parts of two adjacent baseplates are connected by first connecting buckles and the second mounting parts of two adjacent baseplates are connected by second connecting buckles to form a baseplate of different size.

The first connecting buckles comprises a first buckle body, and first telescopic members capable of being deformable under an external force, and the first telescopic members are arranged at two ends of the first buckle body, wherein a telescopic space for allowing the first telescopic members to expand and contract is formed on the first telescopic members at each end of the first buckle body. Preferably, a first flange capable of being clamped on the first mounting parts is provided at an outer edge of the first telescopic member, and the first flange is protruded from an outside face of the first telescopic member. In this case, concave grooves matched with the first flanges should be correspondingly formed on the first mounting part, or snap-joint members are provided. For example, baffles are provided, and a spacing is formed between the baffle and the baseplate so that the first flange is clamped between the baseplate and the baffle.

Preferably, bulges may be provided on the first mounting parts of the baseplate, and a clamping space corresponding to the bugle is formed between the first telescopic members at each of the two ends of the first buckle body.

The second connecting buckle comprises a second buckle body and second telescopic members capable of being deformable under an external force, and the second telescopic members are respectively arranged at two ends of the second buckle body, wherein a second flange capable of being clamped on the second mounting part may be provided at a left or right outer edge of the second telescopic members, and the second flange is protruded from an outside face of the second telescopic member.

Preferably, buckling part capable of buckling the second flange is provided at one end of the second mounting part, and an arc-shaped fastening part is formed at an other end of the second mounting part; convex columns are provided on the second buckle body at positions corresponding to the fastening parts, and an outer circumferential surface of the convex column is clamped into an arc-shaped inside face of the fastening part.

Compared with the prior art, the present application has the following advantages and positive effects.

(1) In the ski mat of the present application, by providing connectors on the bottoms of the supports and by providing mounting holes fitted with the connectors on the baseplate, the supports are more firmly mounted on the baseplate, it is difficult to result in slippage, and it is safer and more reliable.

(2) In the ski mat of the present application, by providing clamping parts preventing slippage on the bottoms of the connectors and by providing mounting holes having different diameters on the baseplate, during a mounting, the clamping part may be first mounted into the first mounting hole and then slide toward the second mounting hole until an outer circumference of the connector is clamped into the second mounting hole. By means of clamped mounting, the mounting of the supports on the baseplate is firmer, and no slippage will occur.

(3) In the spliced baseplate of the present application, baseplates of different size or same size are spliced by additionally providing first connecting buckles and second connecting buckles, so that sizes of the baseplates is not limited, and the baseplates may be flexibly spliced into different size according to different topographies and have a broad range of application.

(4) The connecting buckles of the present application may be designed in two different forms and thus may be matched with different sides of the baseplate.

The present application will be specifically described below by specific embodiments with reference to the accompanying drawings. It is to be noted that, in the description of the present application, a height direction of the ski mat is a direction perpendicular to the ground after the ski mat is mounted; and, an orientation or position relationship indicated by terms such as "inner", "outer", "upper", "lower", "front" or "rear" is a position relationship based on the shown specific locations, and the terms are merely for describing the present application or simplifying description and not intended to indicate or imply that a device or element must have a particular orientation or must be constructed and operated in a particular orientation. Therefore, the terms should not be interpreted as limitations to the present application. Meanwhile, the terms "first" and "second" are merely for description and not intended to indicate or imply relative importance. In addition, numerical signs in the present application are merely used for helping understanding of those skilled in the art and do not constitute any limitations to the protection scope of the present application.

Embodiment 1

Figure 3:
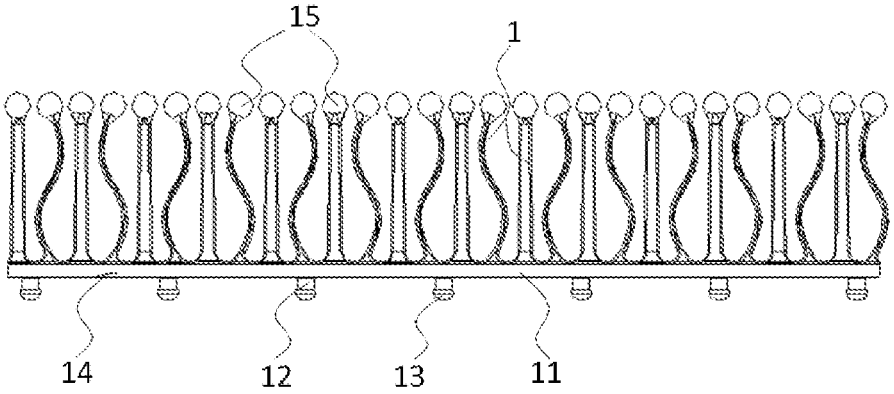
FIG. 3 is a schematic structure diagram of supports in an implementation.
Figure 4:
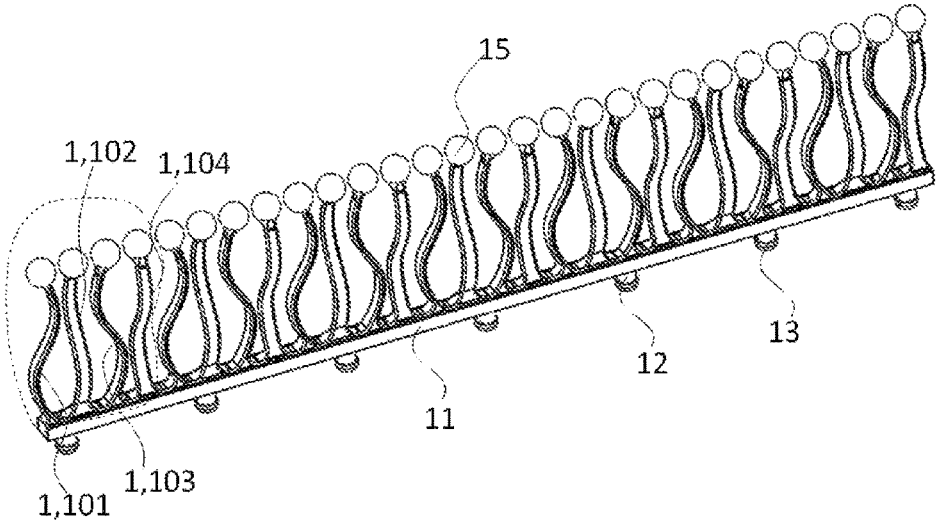
FIG. 4 is a perspective view of FIG. 3.

Referring to FIGS. 1-4, 6 and 7, a ski mat is provided, comprising a baseplate 2 used for paving a ski field and a plurality of supports 1 mounted on the baseplate 2 to support skiing tools. The support 1 may be arc-shaped from top to bottom as shown in FIGS. 3 and 4 or may be in other shapes, and mainly function to support skiing tools. A round-headed bud head 15 may be provided on a top of the support 1. The round-headed shape may be a circular head or an elliptic head. By designing the bud head 15 in the round-headed shape, a friction of sport equipments on the ski mat is reduced, and it is helpful for sliding. A mounting base 11 capable of mounting the supports 1 on the baseplate 2 is provided on bottoms of the supports 1, and a plurality of connectors 12 are provided on a bottom of the mounting base 11. A plurality of mounting holes 21 capable of clamping the connectors 12 are provided on the baseplate 2 at positions corresponding to the connectors 12. The connector 12 is clamped into the mounting hole 21 so that the supports 1 are mounted on the baseplate 2. The connectors 12 may be cylindrical as show in FIG. 3, or may be square or in other shapes. Here, the shape is not specifically limited as long as the connectors are protruded from the bottom of the mounting base to realize connection.

Figure 6:
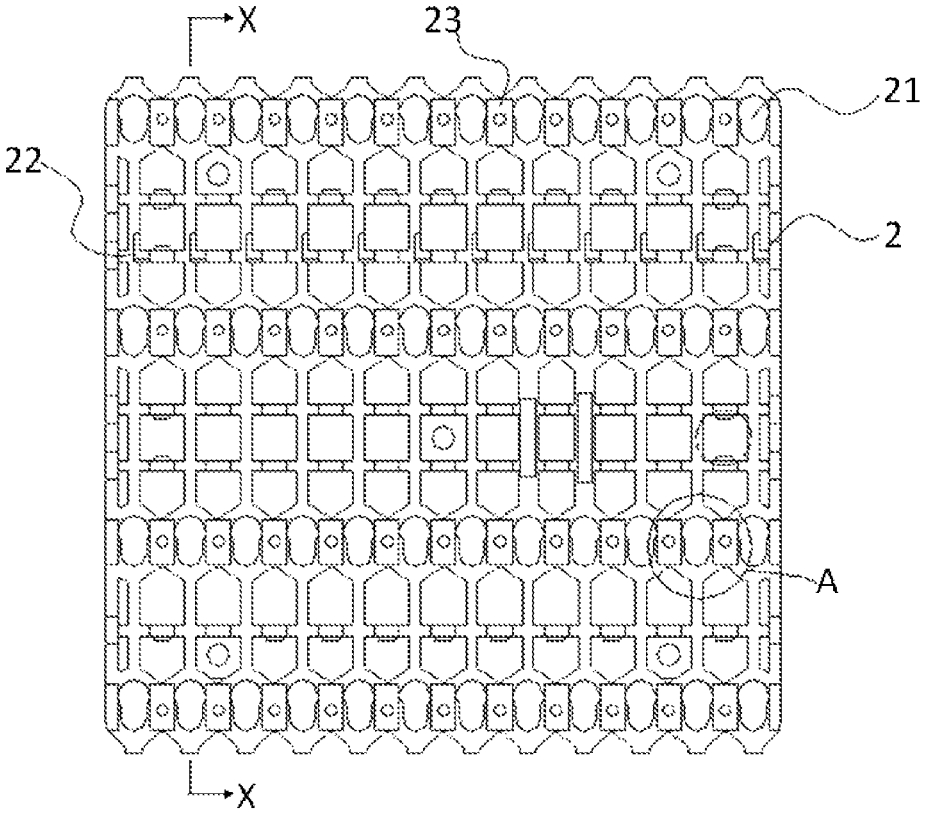
FIG. 6 is a top view of a baseplate of FIG. 1.
Figure 7:
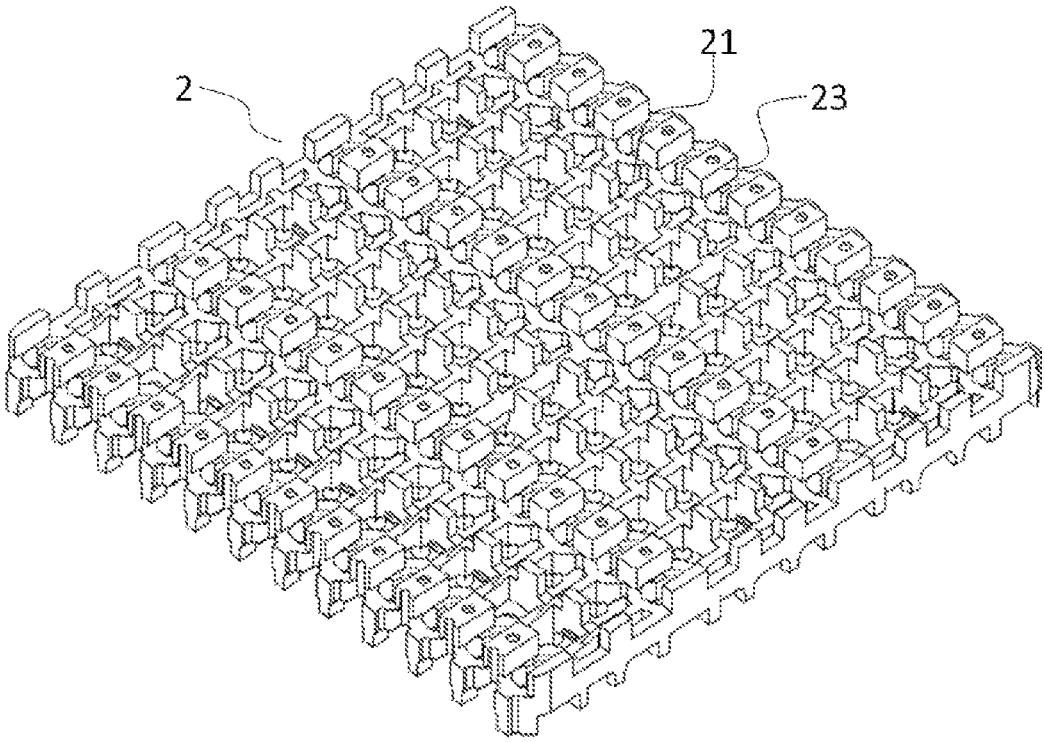
FIG. 7 is a perspective view of FIG. 6.
Figure 8:
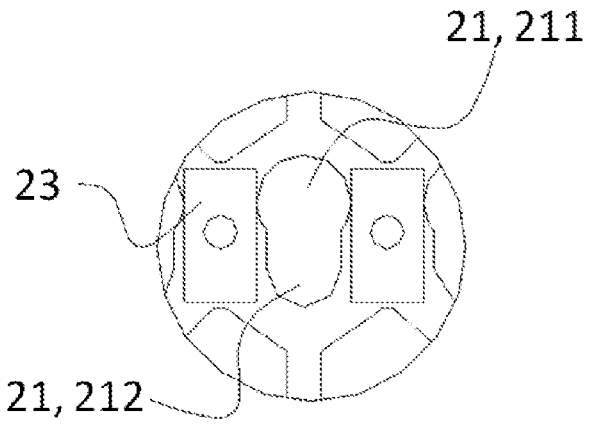
FIG. 8 is a partially enlarged view of part A of FIG. 6.

Referring to FIGS. 3-4 and FIGS. 6-8, a clamping part 13 protruded from an outside face of the connector 12 is integrally provided on a bottom of the connector 12. Here, a shape of the clamping part 13 is not specifically limited, and may be square, circular or the like as long as the clamping part 13 may be protruded from the outside face of the connector. As shown in FIG. 8, the mounting hole 21 comprises two holes connected successively, i.e., a first mounting hole 211 and a second mounting hole 212, wherein the first mounting hole 211 and the second mounting hole 212 are two arc segments having different diameters. The diameter of the first mounting hole 211 is greater than the diameter of the second mounting hole 212 and is not less than a maximum distance between outside faces of the clamping part 13; and the diameter of the second mounting hole 212 is less than the maximum distance between the outside faces of the clamping part 13 and is not less than a maximum distance between outside faces of the connector 12.

In accordance with aforementioned solution, mounting the supports 1 on the baseplate 2 is specifically as follows: the clamping part 13 are mounted into the first mounting hole 211, and the connector 12 and the clamping part 13 as a whole are moved toward the second mounting hole 212 along the first mounting hole 211 until the connector 12 is clamped into the second mounting hole 212. By such a clamping structure, a connection of the support 1 and the baseplate 2 is firmer, it is difficult to result in slippage, and it is safer for a skier during skiing.

Embodiment 2

Based on Embodiment 1, as shown in FIGS. 3 and 4, from left to right, every four of the supports form one group of the supports (shown by a dashed box in FIG. 4), i.e., a first support 101, a second support 102, a third support 103 and a fourth support 104, respectively. Each group of the supports comprises two supports having radians which are left-right symmetrical and two supports having radians which are front-rear symmetrical. In FIG. 4, the first support 101 and the third support 103 are arranged left-right symmetrically, and the second support 102 and the fourth support 104 are arranged front-rear symmetrically. In this way, each group of the supports has four bending directions and thus can effectively withstand stress generated by skiing in multiple directions. Alternatively, the first support and the second support may be arranged left-right symmetrically, and the third support and the fourth support may be arranged front-rear symmetrically.

Embodiment 3

Figure 5:
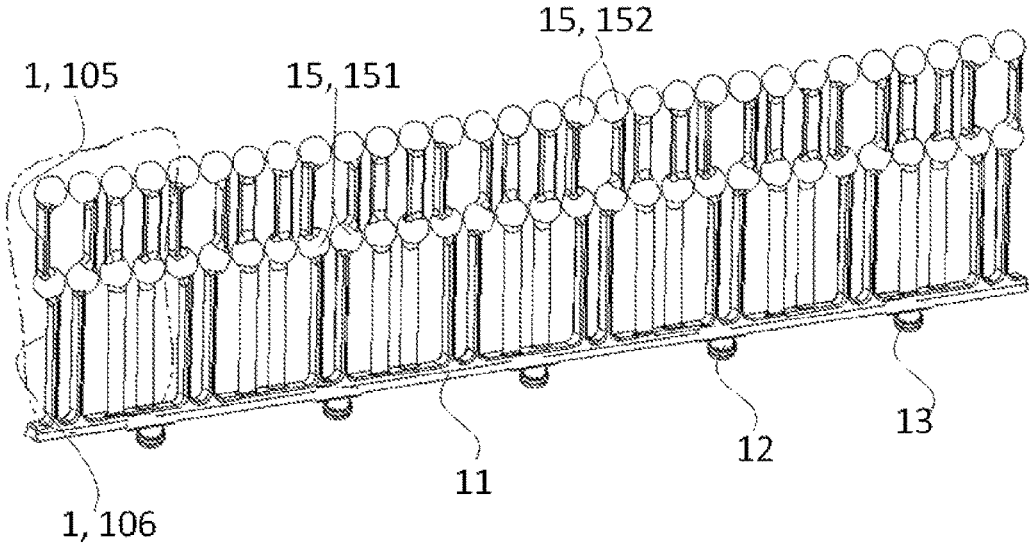
FIG. 5 is a schematic structure diagram of supports in another implementation.

Based on Embodiment 1 or 2, as shown in FIG. 5, the support 1 comprises two supports arranged up and down, i.e., an upper support 105 and a lower support 106. A bottom of the lower support 106 is mounted on the mounting base 11, a first bud head 151 is provided between the lower support 106 and the upper support 105, and a second bud head 152 is provided on a top of the upper support. The upper support 105 and the lower support 106 may be eccentrically arranged on the first bud head 151 and are distributed on two sides of the first bud head, respectively. As shown in a dashed box in FIG. 5, when four of the supports form one group of the supports, eccentric directions of two supports may be left-right symmetrical, and eccentric directions of other two supports may be front-rear symmetrical. As shown, eccentric directions of the first support 101 and the second support 102 are left-right symmetrical, and eccentric directions of the third support 103 and the fourth support 104 are front-rear symmetrical. Due to different eccentric directions, the ski mat may withstand stress generated by skiing in multiple directions.

Embodiment 4

Figure 9:
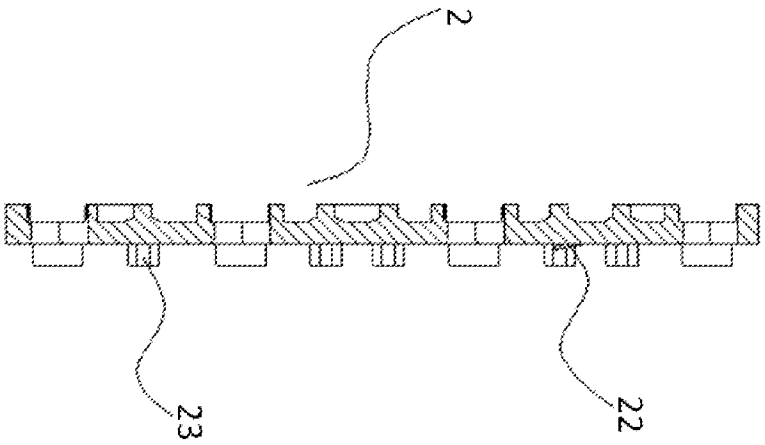
FIG. 9 is a sectional view of FIG. 6 taken along X-X.

Based on Embodiment 1, 2 or 3, as shown in FIGS. 6, 7 and 9, a plurality of bumps 22 (not shown in FIG. 7) protruded from the baseplate 2 are further provided on the baseplate 2. The bump 22 is arranged between two adjacent mounting holes 21 in a direction for mounting the supports 1, that is, the bumps 22 and the mounting holes 21 are alternately arranged in the direction for mounting the supports. In FIG. 6, both the supports 1 and the mounting base 11 are mounted vertically, and the bumps 22 and the mounting holes 21 may be alternately arranged in a vertical direction. In the drawings, only one of the bosses 22 is exemplarily shown in each direction for mounting the mounting base 11. Clamping slots 14 capable of clamping the bumps 22 are provided on the mounting base 11 at positions corresponding to the bumps 22. As shown in FIG. 3, the clamping slot 14 is concavely arranged on the bottom of the mounting base 11. Here, by matching the correspondingly arranged clamping slots 14 and bosses 22, a positioning function is achieved, and it is advantageous for further clamping the supports 1 and the baseplate 2.

An upper surface of the bump 22 is an inclined surface, and side faces of the bump 22 are vertical surfaces; and, an inward concave bottom surface of the clamping slot 14 is an inclined surface arranged in correspondence to the bump 22, and side faces of the clamping slot 14 are vertical surfaces capable of being fitted to the vertical surfaces of the bumps. The aforementioned inclined surface is convenient for mounting of the support 1. Mounting the inclined surface of the bump 22 along the inclined surface of the clamping slot 14, until the vertical surfaces of the bump 22 are clamped with the vertical surfaces of the clamping slot 14, so that the mounting is more accurate and firmer.

In addition, a plurality of bosses 23 protruded from the baseplate 2 may also be provided on the baseplate 2, and the bosses 23 are mounted between two adjacent rows of the mounting holes 21 correspondingly to the mounting holes 21 so as to position the supports and the mounting base.

Embodiment 5

Figure 10:
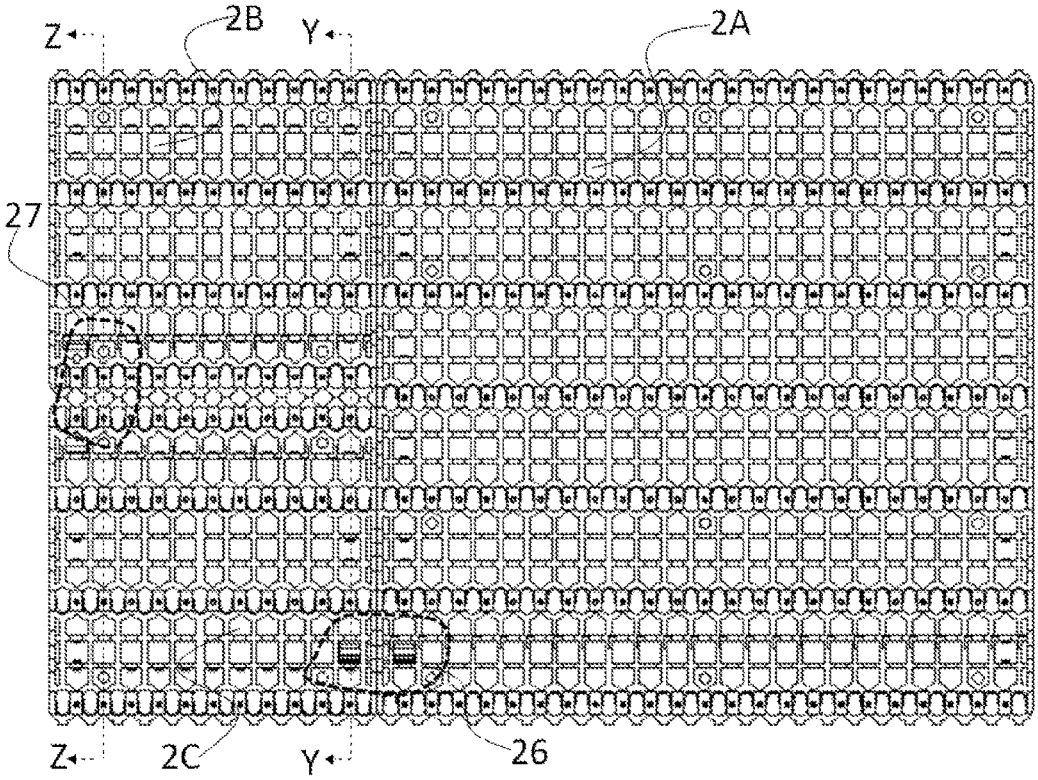
FIG. 10 is a schematic structure diagram of a spliced baseplate.

As shown in FIGS. 10-12, FIG. 14 and FIG. 17, a spliced baseplate is provided, which may be used for mounting the supports 1 of the ski mat according to any one of Embodiments 1-4, comprising a plurality of baseplates 2, wherein the baseplates are quadrangular, and a plurality of first mounting parts 26 are arranged at intervals on two opposite sides of the quadrangular baseplates (only one of the first mounting parts 26 is exemplarily shown in FIG. 10) and a plurality of second mounting parts 27 are arranged at intervals on other two opposite sides of the quadrangular baseplates (only one of the second mounting parts 27 is exemplarily shown in FIG. 10). The first mounting parts 26 or the second mounting parts 27 of two adjacent baseplates are aligned with each other, that is, the plurality of first mounting parts are aligned with each other and the plurality of second mounting parts are aligned with each other. The first mounting parts 26 of two adjacent baseplates 2 are connected by first connecting buckles 24 and the second mounting parts 27 of two adjacent baseplates 2 are connected by second connecting buckles 25 to form a baseplate of different size.

FIG. 10 shows a schematic diagram of the spliced baseplate. For example, the plurality of baseplates 2 are a first baseplate 2A, a second baseplate 2B and a third baseplate 2C, respectively, wherein the first baseplate 2A has a size of 240 mm×240 mm, and the second baseplate 2B and the third baseplate 2C have a size of 120 mm×120 mm. On each of the first baseplate 2A, the second baseplate 2B and the third baseplate 2C, the first mounting parts 26 are arranged on left and right opposite sides, and the second mounting parts 27 are arranged on upper and lower opposite sides. Specifically, a plurality of the first mounting parts 26 are arranged on the left side of the first baseplate 2A, the right side of the second baseplate 2B, the left side of the first baseplate 2A and the right side of the third baseplate 2C, respectively. As an example, one first mounting part 26 on the left side of the first baseplate 2A and on the right side of the third baseplate 2C is shown in FIG. 10. A plurality of the second mounting parts 27 are arranged on the lower side of the second baseplate 2B and the upper side of the third baseplate 2C, respectively. As an example, only one second mounting part 27 is shown in FIG. 10. During a splicing, sides of first mounting parts on the first baseplate 2A and sides of first mounting parts on the second baseplate 2B and the third baseplate 2C are aligned with each other and connected by the first connecting buckles 24; and, sides of second mounting parts on the second baseplate 2B and the third baseplate 2C are adjacent to each other and connected by the second connecting buckles 25. It can be seen from this embodiment that the spliced baseplate of the present application is not limited by sizes of baseplates and is highly flexible for different places. In addition, it is to be further noted that, this embodiment is merely an example. Actually, the present application may not only comprise the splicing of baseplates of different size, but also comprise splicing of baseplates of a same size.

Figure 13:
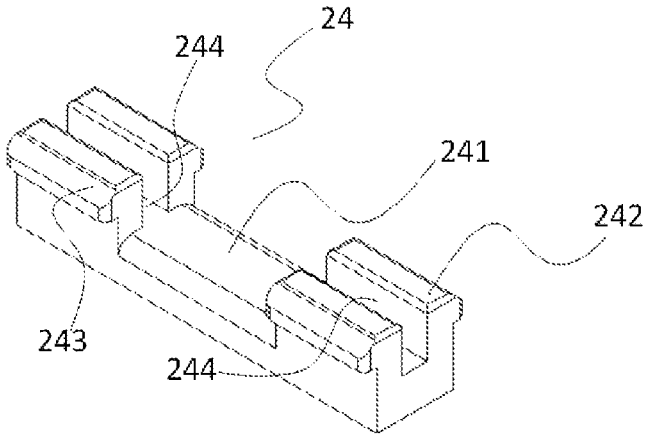
FIG. 13 is a schematic structure diagram of a first connecting buckle.
Figure 14:
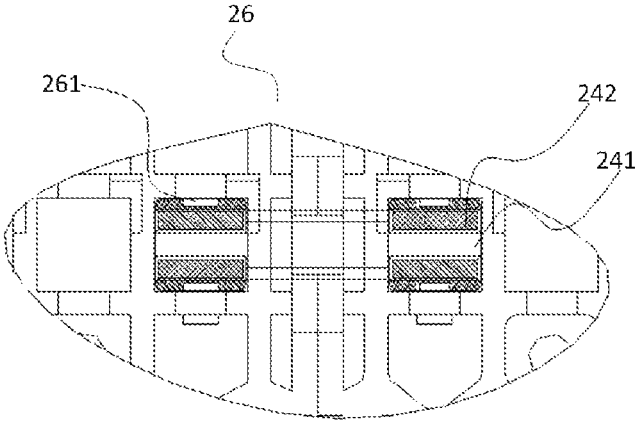
FIG. 14 is a partially enlarged view of a first mounting part 26 of FIG. 10.

As shown in FIGS. 13 and 14, the first connecting buckles 24 comprises a first buckle body 241, and first telescopic members 242 capable of being deformable under an external force, and the first telescopic members 242 are provided at two ends of the first buckle body 241, wherein a telescopic space for allowing the first telescopic members 242 to expand and contract is formed on the first telescopic members 242 at each end of the first buckle body.

Figure 11:
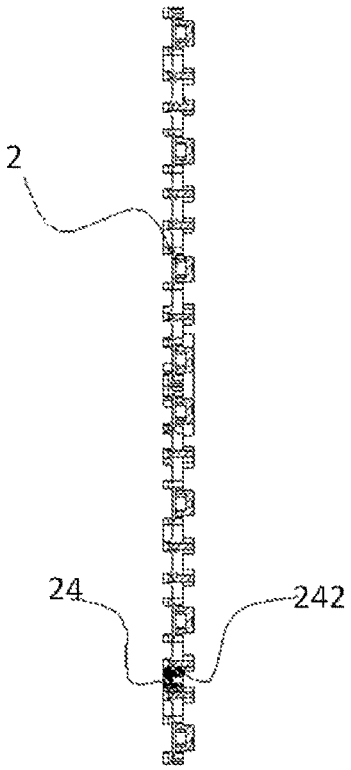
FIG. 11 is a sectional view of FIG. 10 taken along Y-Y.

In addition, in order to better mount the first telescopic members 242 into the first mounting parts 26, a first flange 243 capable of being clamped on the first mounting parts 26 may also be provided on an outer edge of the first telescopic member 242, and the first flange 243 is protruded from an outside face of the first telescopic member 242. Snap-joint members (for example, baffles 261 shown in FIG. 14) are correspondingly provided on the first mounting part, so that the first flanges 26 are clamped into spacings between the baseplate and the baffles 261. In addition, bulges (not shown) may be provided on the first mounting parts 26 of the baseplate, and a clamping space 244 corresponding to the bugle is formed between the first telescopic members 242 at each of the two ends of the first buckle body 241. With such a structure, during mounting of the first connecting buckles 24 into the first mounting parts 26, an external force is applied to contract the first telescopic members 242 inward, and the contracted first connecting buckles 24 are clamped into the first mounting parts 26, as shown in FIGS. 11 and 14.

Figure 15:
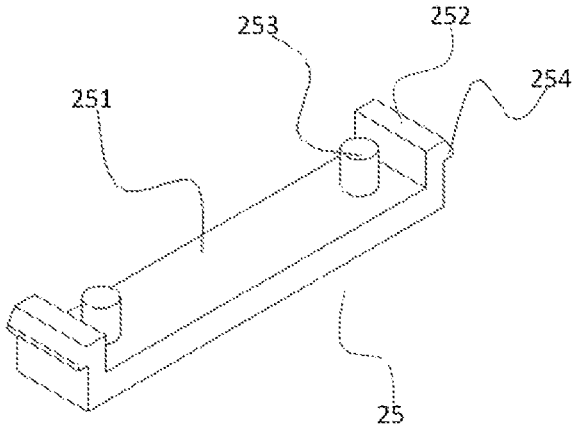
FIG. 15 is a schematic structure diagram of a second connecting buckle in an implementation.
Figure 17:
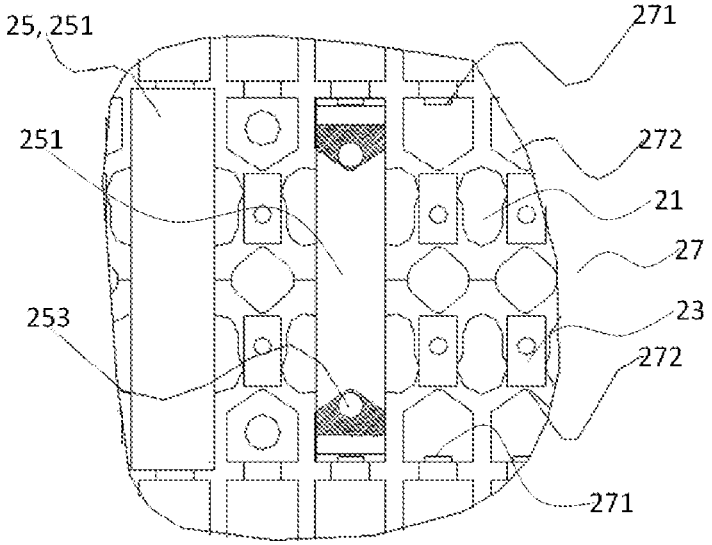

As shown in FIGS. 15 and 17, the second connecting buckle 25 comprises a second buckle body 251 and, second telescopic members 252 capable of being deformable under an external force, and the second telescopic members 252 are respectively arranged at two ends of the second buckle body 251, wherein a second flange 254 capable of being clamped on the second mounting part 27 may be provided on a left or right outer edge of the second telescopic member 252, and the second flange 254 is protruded from an outside face of the second telescopic member 252.

As shown in FIG. 17, buckling part 271 capable of buckling the second flange 254 is provided at one end of the second mounting part 27, the buckling part 271 may be a rectangular bugle, and an arc-shaped fastening part 272 is formed at an other end of the second mounting part 27. Convex columns 253 are provided on the second buckle body 251 at positions corresponding to the fastening parts 272, and an outer circumferential surface of the convex column 253 is clamped into an arc-shaped inside face of the fastening part 272. In the drawings, the convex column 253 is located between the boss 23 and the arc-shaped surface of the fastening part 272 so that the second connecting buckles 25 may be prevented from moving back and forth after being mounted. Moreover, due to the second flanges 254, the second connecting buckles 25 may be prevented from moving around.

Figure 12:
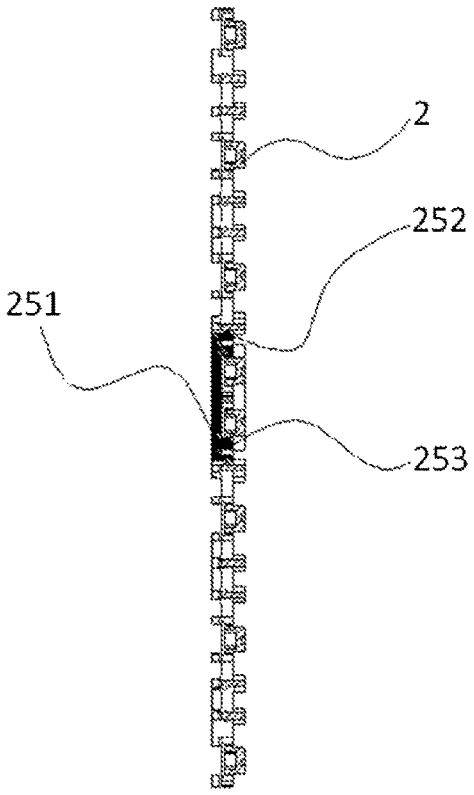
FIG. 12 is a sectional view of FIG. 10 taken along Z-Z.

With this structure, during mounting the second connecting buckle 25 onto the second mounting part 27, an external force is applied to contract the second telescopic members 252 inward, the convex columns 253 are mounted in such a way that the convex columns 253 are matched with the fastening parts 272, and the contracted second connecting buckle 25 is clamped into the second mounting part 27. At the moment, the buckling parts 271 are just resisted against the second flange 254 of the second telescopic member, as shown in FIGS. 12 and 17.

Embodiment 6

Except the following technical features, remaining technical features are the same as those in Embodiment 5.

Figure 16:
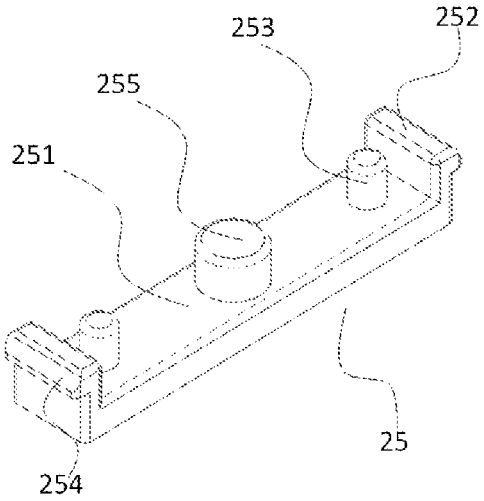
FIG. 16 is a schematic structure diagram of the second connecting buckle in another implementation.

In this embodiment, as shown in FIG. 16, a middle convex column 255 is provided on the second buckle body 251, two convex columns 253 are located at two ends of the second buckle body 251, and the middle convex column 255 is located between the two convex columns 253. A corresponding opening matched with the middle convex column is formed on the baseplate 2, so that the second buckle body 251 is more firmly mounted on the baseplate 2 and an offset of the second buckle body 251 may be effectively prevented.

The invention claimed is:

1. A ski mat, comprising a baseplate (2) used for paving a ski field and a plurality of supports (1) mounted on the baseplate (2) to support skiing tools, wherein a mounting base (11) capable of mounting the supports (1) on the baseplate (2) is provided on bottoms of the supports (1), and a plurality of connectors (12) are provided on a bottom of the mounting base (11); a plurality of mounting holes (21) capable of clamping the connectors (12) are provided on the baseplate (2) at positions corresponding to the connectors (12); and, the connector (12) is clamped into the mounting hole (21) so that the supports (1) are mounted on the baseplate (2); a plurality of bumps (22) protruded from the baseplate (2) are provided on the baseplate (2), and the bump (22) is arranged between two adjacent mounting holes (21) in a direction for mounting the supports (1); and, clamping slots (14) capable of clamping the bumps (22) are formed on the mounting base (11) at positions corresponding to the bumps (22), and the clamping slots (14) are concavely arranged on the bottom of the mounting base (11).

2. The ski mat according to claim 1, wherein, a clamping part (13) protruded from an outside face of the connector (12) is integrally provided on a bottom of the connector (12); the mounting hole (21) comprises two holes connected successively, that is, a first mounting hole (211) and a second mounting hole (212), wherein the first mounting hole (211) and the second mounting hole (212) are two arc segments having different diameters; the diameter of the first mounting hole (211) is greater than the diameter of the second mounting hole (212) and is not less than a maximum distance between outside faces of the clamping part (13); the diameter of the second mounting hole (212) is less than the maximum distance between the outside faces of the clamping part (13) and is not less than a maximum distance between outside faces of the connector (12).

3. The ski mat according to claim 2, wherein, an upper surface of the bump (22) is an inclined surface, and side faces of the bump (22) are vertical surfaces; and, an inward concave bottom surface of the clamping slot (14) is an inclined surface arranged in correspondence to the bump (22), and side faces of the clamping slot (14) are vertical surfaces capable of being fitted to the vertical surfaces of the bump (22).

4. The ski mat according to claim 2, wherein, a plurality of bosses (23) protruded from the baseplate (2) are provided on the baseplate (2), and the bosses (23) are arranged between two adjacent rows of the mounting holes (21) correspondingly to the mounting holes (21).

5. The ski mat according to claim 2, wherein, the support (1) is an arc-shaped strip from top to bottom.

6. The ski mat according to claim 5, wherein, four of the supports (1) form one group of the supports, each group of the supports comprises two supports (1) having radians which are left-right symmetrical and two supports (1) having radians which are front-rear symmetrical.

7. The ski mat according to claim 2, wherein, a round-headed bud head (15) is provided on a top of the support (1).

8. The ski mat according to claim 7, wherein, the support (1) comprises two supports arranged up and down, that is, an upper support (105) and a lower support (106); a bottom of the lower support (106) is mounted on the mounting base (11), a first bud head (151) is provided between the lower support (106) and the upper support (105), and a second bud head (152) is provided on a top of the upper support (105).

9. The ski mat according to claim 8, wherein, the upper support (105) and the lower support (106) are eccentrically arranged on the first bud head (151) and are distributed on two sides of the first bud head (151), respectively.

10. The ski mat according to claim 9, wherein, when four of the supports (1) form one group of the supports, eccentric directions of two supports (1) are left-right symmetrical, and eccentric directions of other two supports (1) are front-rear symmetrical.

11. The ski mat according to claim 1, wherein, an upper surface of the bump (22) is an inclined surface, and side faces of the bump (22) are vertical surfaces; and, an inward concave bottom surface of the clamping slot (14) is an inclined surface arranged in correspondence to the bump (22), and side faces of the clamping slot (14) are vertical surfaces capable of being fitted to the vertical surfaces of the bump (22).

12. The ski mat according to claim 1, wherein, a plurality of bosses (23) protruded from the baseplate (2) are provided on the baseplate (2), and the bosses (23) are arranged between two adjacent rows of the mounting holes (21) correspondingly to the mounting holes (21).

13. The ski mat according to claim 1, wherein, the support (1) is an arc-shaped strip from top to bottom.

14. The ski mat according to claim 13, wherein, four of the supports (1) form one group of the supports, each group of the supports comprises two supports (1) having radians which are left-right symmetrical and two supports (1) having radians which are front-rear symmetrical.

15. The ski mat according to claim 1, wherein, a round-headed bud head (15) is provided on a top of the support (1).

16. The ski mat according to claim 15, wherein, the support (1) comprises two supports arranged up and down, that is, an upper support (105) and a lower support (106); a bottom of the lower support (106) is mounted on the mounting base (11), a first bud head (151) is provided between the lower support (106) and the upper support (105), and a second bud head (152) is provided on a top of the upper support (105).

17. The ski mat according to claim 16, wherein, the upper support (105) and the lower support (106) are eccentrically arranged on the first bud head (151) and are distributed on two sides of the first bud head (151), respectively.

18. The ski mat according to claim 17, wherein, when four of the supports (1) form one group of the supports, eccentric directions of two supports (1) are left-right symmetrical, and eccentric directions of other two supports (1) are front-rear symmetrical.

* * * * *